US005228563A

United States Patent [19]

Stringham

[11] Patent Number: 5,228,563

[45] Date of Patent: Jul. 20, 1993

[54] KEY CASE

[76] Inventor: Richard B. Stringham, 522 E. First South, Salt Lake City, Utah 84102

[21] Appl. No.: 801,751

[22] Filed: Dec. 3, 1991

[51] Int. Cl.[5] ..... A45C 11/32

[52] U.S. Cl. ..... 206/38.1; 206/37.2; 206/37.8

[58] Field of Search ..... 206/37.1, 37.2, 37.3, 206/37.4, 37.5, 37.8, 38.1

[56] References Cited

U.S. PATENT DOCUMENTS

| | | | |
|---|---|---|---|
| 1,936,273 | 11/1933 | Segal | 206/37.2 X |
| 2,076,895 | 4/1937 | Johnston | 206/37.2 |
| 2,176,863 | 10/1939 | Nash | 206/37.2 |
| 2,601,331 | 6/1952 | Segal | 206/37.2 |
| 2,912,030 | 11/1959 | Stiller | 206/37.2 |
| 3,354,678 | 11/1967 | Stifelman | 206/37.2 X |
| 4,307,590 | 12/1981 | Friedland | 206/37.2 X |
| 4,934,521 | 6/1990 | Gebert | 206/37.2 X |
| 4,951,819 | 8/1990 | Gebert | 206/37.2 |

*Primary Examiner*—Steven N. Meyers
*Assistant Examiner*—Jacob K. Ackun, Jr.
*Attorney, Agent, or Firm*—Thorpe, North & Western

[57] ABSTRACT

A key case which ejects and retracts keys comprises a housing, a mounting block disposed inside the housing, and a bail for holding keys attached to the mounting block. The mounting block contains two arms which extend into and slidingly engage internal grooves in the housing, by which arrangement the mounting block, bail, and keys move smoothly through the housing. An external thumbscrew attaches through a slot in the side of the housing to the mounting block by a connecting rod. The mounting block is moved through the housing by means of the thumbscrew.

15 Claims, 3 Drawing Sheets

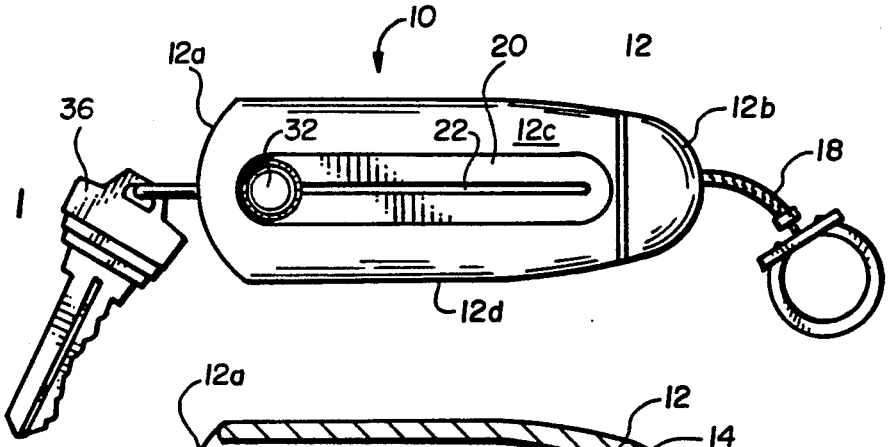
Fig. 1
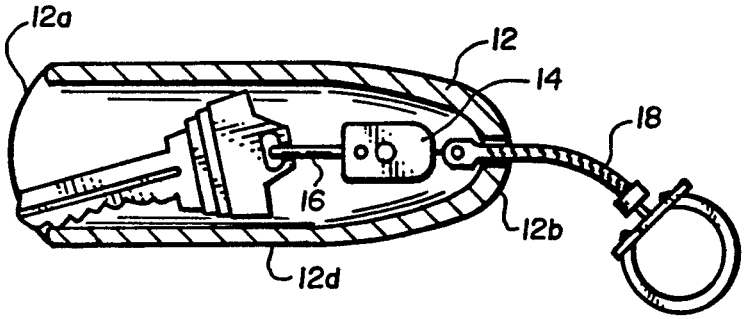
Fig. 2
Fig. 3
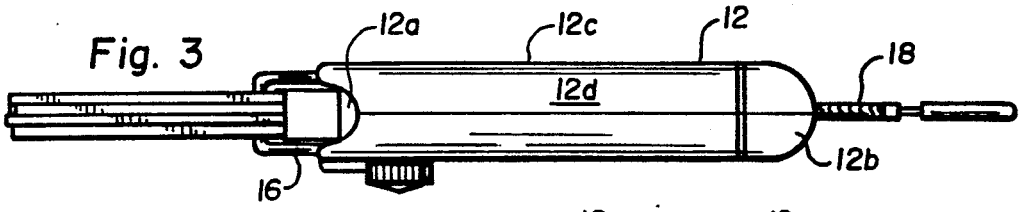
Fig. 4
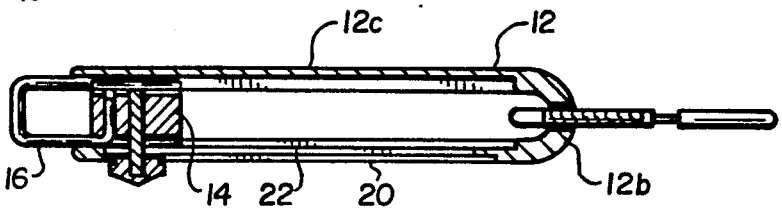
Fig. 5
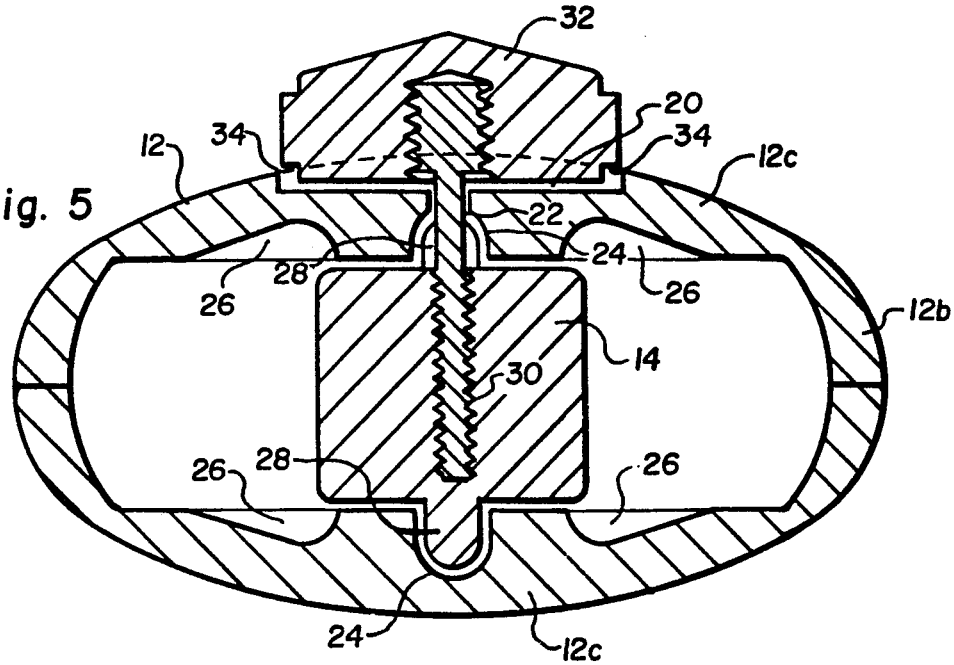

KEY CASE

FIELD OF THE INVENTION

The present invention relates to the art of key cases, and particularly to those in which keys may be retracted for storage and ejected for operation.

BACKGROUND OF THE INVENTION

Key cases of various configurations have been used for many years to minimize the inconveniences of storing and operating keys which hang loose from a key ring. Loose keys are noisy, may poke holes in pockets, and may cause inconvenience in locating and selecting a particular key when needed. Additionally, loose keys can scratch the finish of, e.g., the area of a car door adjacent to the lock when unlocking or locking the door.

Prior art key cases have addressed these concerns with varying degrees of success. Many cases hold all keys other than the one being used during operation to minimize or eliminate scratching of surfaces adjacent the keyhole, but these key cases often increase the difficulty of selecting the key to be used and sometimes require the user to replace the key in the case in an exact way. Cases can also be bulky and heavy which make them unsuitable for placement in, e.g., a pants pocket. Binding and tangling of keys in the case can also be a problem.

Another concern with some key cases is that they do not allow for complete ejection of the key from the case. This can be a problem with regard to certain automobile ignition key receptacles into which the entire head of the key must be inserted. It is also desirable to be able to select and replace keys in the case with only one hand, eliminating the need to set down grocery bags, babies, books, briefcases, or other objects which the user may be carrying. Convenience of installation and removal of the keys in the case is also a concern.

A particular class of key cases comprises a housing into which the key is placed, which housing has a slot running longitudinally down its side. A device holding the top of the key is attached to a protrusion of some kind through the slot, enabling the user to slide the key into and out of the casing by moving the protrusion. References disclosing this type of key case include Gebert U.S. Pat. No. 4,951,819, Friedland U.S. Pat. No. 4,307,590, Hinkle U.S. Pat. No. 3,464,244, and Stifelman U.S. Pat. No. 3,354,678. Many of these kinds of cases retain some or all of the disadvantages outlined above, and binding and mis-alignment of keys in the cases is a common problem. In addition, some of these cases allow for storage of only one key or provide various compartments each holding only one key, creating obvious disadvantages of limited use or bulk. Other types of key cases are disclosed in Gebert, U.S. Pat. No. 4,934,521, and Leopoldi et al., U.S. Pat. No. 4,281,527.

OBJECTS AND SUMMARY OF THE INVENTION

It is therefore an object of the present invention to overcome the disadvantages of the prior art.

It is a further object of the invention to provide a small lightweight key case capable of holding a plurality of keys which is easily operable with only one hand.

It is a further object of the invention to provide a key case from which a key is fully ejected and into which the key is conveniently and quickly replaced.

It is a further object of the invention to minimize binding and alignment problems common to sliding key retraction/ejection cases while holding a plurality of keys.

It is a further object of the invention to provide a key case in which keys may be conveniently installed and removed.

In accordance with a first aspect of the invention, an apparatus for holding, ejecting, and retracting keys comprises a housing, an interior groove disposed on an interior side of the housing, means for holding keys disposed in the housing in sliding engagement with the interior groove, and means for longitudinally moving the means for holding keys relative to the housing, whereby the keys are selectively ejected from and retracted into the housing.

In accordance with a second aspect of the invention, a key case comprises a housing having an open end, a longitudinal slot having a first end and a second end disposed on a side of the housing, and a key holding device having a key installation/removal point disposed thereon, disposed within the housing. A thumbscrew is disposed outside of the housing and a rod operatively connects the key holding device to the thumbscrew through the slot, the thumbscrew being selectively removable from the rod, e.g., by the thumbscrew and rod being cooperatively threaded. When the thumbscrew is totally or partially removed and the rod is pushed to the first end of the slot, the key holding device protrudes from the open end of the housing exposing the key installation/removal point. Means for delimiting the movement of the thumbscrew is provided on the housing and placed such that movement of the thumbscrew is arrested near the first end of the slot, at which point the rod is disposed near the first end of the slot and the key holding device protrudes from the open end of the housing without exposing the key installation/removal point.

Specifically, and in a preferred embodiment, a key case comprises a housing having an open end and a first groove disposed on an exterior wall of the housing. The groove has a first end and a second end, the first end being nearer to the open end of the housing than the second end. A slot smaller in length than the groove is substantially centered in the groove. The slot has a first end and a second end corresponding to the first and second ends of the first groove. A second groove is disposed on an interior wall of the housing, and a mounting block is provided in the housing. An arm protrudes from the mounting block into the second groove, which arm is adapted to guide movement of the mounting block along the second groove. A connector having a first end and a second end is disposed through the slot, the first end being secured to the mounting block. Means for manually displacing the connector are releasably secured to the second end of the connector, the manual displacement means being slidingly engaged with the first groove when secured to the second end of the connector. A bail adapted to hold keys is secured to the mounting block such that a side of the bail engages the second groove in sliding relationship, the bail having an open point at which keys may be added or removed.

In this embodiment, when the manual displacement means is placed at the first end of the first groove, part of the bail not including the open point protrudes from the open end of the housing, and when the manual displacement means is removed or loosened from the connector and the connector is placed at the first end of the slot, a greater portion of the bail, including the open point, protrudes from the open end of the housing.

BRIEF DESCRIPTION OF THE DRAWINGS

These and other objects, aspects, and embodiments of the present invention will be described with reference to the following drawing figures, of which:

FIG. 1 is a front elevational view of a key case according to the invention, with the keys ejected;

FIG. 2 is a front view in cross-section of the key case of FIG. 1, with the keys retracted;

FIG. 3 is a side elevational view of the key case of FIG. 1;

FIG. 4 is a side view in cross section of the key case of FIG. 1;

FIG. 5 is a top view in cross-section of the key case of FIG. 1;

DETAILED DESCRIPTION OF THE INVENTION

Figure 6:
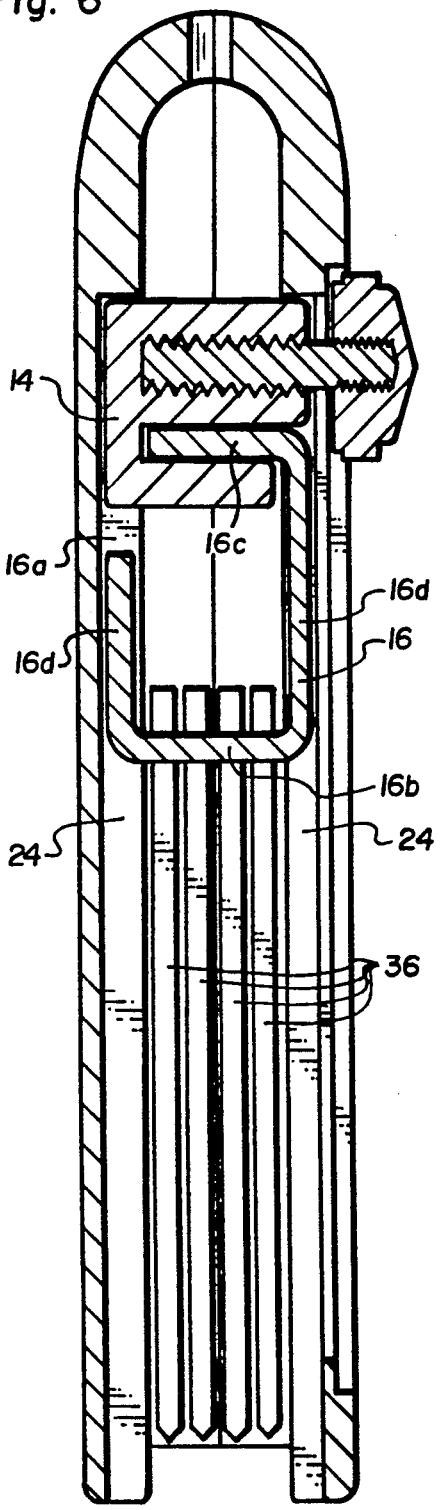
FIG. 6 is a detail side view in cross section of the key case of FIG. 1, with the keys in retracted position.

Referring first to FIGS. 1 to 4, a key case 10 comprises a housing or casing 12, a mounting block 14, and a wire bail 16 secured to the mounting block 14. The housing 12 has a relatively wide open end **12*a* and a relatively narrow opposing closed end 12*b*. The housing 12 is preferably substantially elliptical in cross-section (FIG. 5) A chain 18 is attached by any suitable means to the narrow end of the housing 12*b*. The particular embodiment shown is intended for use with four keys, though the case may be readily widened to accommodate different numbers of keys, as will be apparent to those skilled in the art in light of this disclosure. The housing 12 is relatively thin and wide to closely correspond to the shape of the keys without being unduly bulky and to make it easy to grip, resulting in rounded broad sides 12*c* and narrow sides 12*d*. An exterior longitudinal recess or groove 20 is disposed in one broad side 12*c* of the housing, the ends of the groove approaching the ends of the housing 12*a* and 12*b*. A slot 22 is contained in the groove 20, its length being centered in and slightly less than that of the groove. Referring now to FIG. 5, interior recesses or grooves 24 are disposed in the housing on the interior of the broad sides 12*c* of the housing. Additional recesses 26 are cut into the interior of the broad sides 12*c* to the sides of the interior grooves 24 to conserve construction material of the housing 12**, which preferably comprises a suitably rigid plastic.

The mounting block 14 has arms 28 which slidingly engage the interior recesses 24 of the housing 12. A connecting rod 30 is secured to the body of the mounting block 14 and protrudes through an arm 28 and the slot 22 to the exterior of the housing 12, at which point the rod is threaded. A thumbscrew 32 is screwed onto the threaded portion of the rod 30. The thumbscrew 32 is adapted to fit into the exterior groove 20 by means of cutout shoulders 34. By means of the connecting rod 30, movement of the thumbscrew 32 along the slot 22 will cause similar sliding movement of the mounting block 14, specifically, sliding of the arms 28 in the interior grooves 24. The tightness of fit of the thumbscrew 32 in the exterior groove 20 can be adjusted by screwing it a greater or lesser amount onto the connecting rod 30, whereby the ease of movement of the same along the slot 22 is similarly adjusted owing to the fact that resistance is heightened proportionately to tightness of fit of the thumbscrew in the exterior groove.

In a preferred embodiment, as the mounting block 19 is moved toward the narrow end of the housing **12*b*, the progressively smaller interior cross-section of the housing 12 secures the mounting block 14 in a retracted position through pressure of the housing against the mounting block 14**.

Referring now to FIG. 6, the wire bail 16 is formed in the shape of a rectangle having an open corner **16*a* for placement and removal of keys on the bail. The bottom section of the bail 16*b* holds keys 36 in place, and the top section of the bail 16*c* is secured in the mounting block 14. The side sections 16*d* of the bail, like the arms 28 of the mounting block, are placed in sliding engagement with the interior recesses 24 of the housing 12. Thus, due to the attachment of the bail 16 to the mounting block 14 and the sliding engagement of the side sections 16*d* with the interior recesses 24, when the mounting block 14 is moved due to manual displacement of the thumbscrew 32 the bail 16 along with the keys 36** move with it.

The sliding engagement of the arms 28 and side sections **16*d* of the bail with the interior grooves 24 guides the movement of the mounting block 14, bail 16, and keys 36 through the housing 12 without binding or twisting. Movement is predictable, and the need for the user to use his other hand to free the keys from occasional binding is eliminated. Damage to the housing by binding of the key bits is also thereby minimized. This guiding arrangement eliminates the need for the mounting block 14** to be big enough to snugly fit into the entire cross section of the housing for alignment as is done in, e.g., Gebert U.S. Pat. No. 4,934,521.

Figure 7:
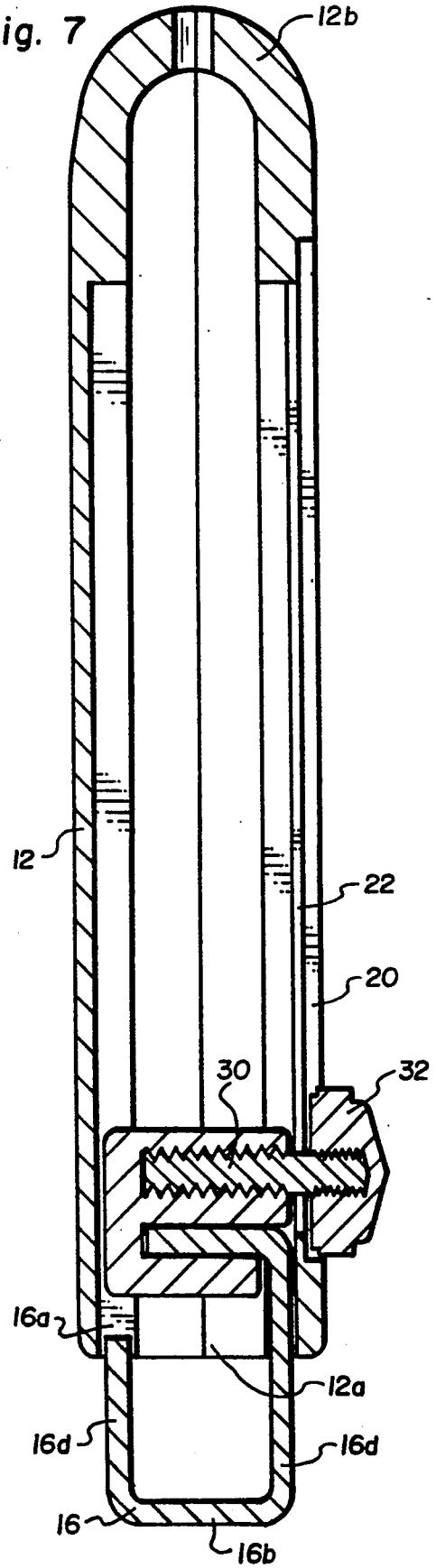
FIG. 7 is a detail side view in cross section of the key case of FIG. 1, with the keys in ejected position.

As shown in FIG. 7, when the thumbscrew 32 is moved by the user to its position nearest the open end **12*a* of the housing at the end of the exterior groove 20, the bottom section 16*b* and much of the side sections 16*d* of the bail protrude from the open end 12*a* of the housing which causes the keys 26 to completely eject from the housing 12, allowing one or more of them to be used as desired. The interior walls of the housing 12 are preferably smooth to prevent binding or catching of the ends of the keys during ejection. Although the connecting rod 30 attached to the thumbscrew is not yet at the end of the slot 22 in this position, further movement is prevented by the abutment of the thumbscrew 32 against the side of the exterior groove 20. At this position, the open corner 16*a* of the bail is not exposed out of the housing, so there is no danger of a key inadvertently leaving the bail 16. To retract the keys 36 into the housing 12, the user simply pushes the thumbscrew 32 back to the position nearest the closed end 12*b* of the housing at the opposite end of the exterior groove 20, which moves the mounting block 14, bail 16, and keys 36 back into the housing 12 (FIG. 6). Preferably, the housing 12** is long enough to house the complete length of the keys.

The key case is preferably constructed to accommodate a certain number of keys 36. This is done by choosing the length of the bottom section **16*b* of the bail to be just long enough for the pre-selected number of keys to fit it. The keys 36 thereby press against each other and the side sections 16***d* of the bail preventing them from laterally moving up the side sections 16*d* of the bail, i.e., their only movement will be pivotal around the axis of the bottom section 16*b* of the bail to which they are attached. This arrangement has the advantage of preventing banging of the keys against the housing 12 when they are retracted into it. Though preferable, this arrangement is not critical to the functioning of the invention since the sides of the housing 12 will press any errant keys into their proper place on the bottom section 16*b* of the bail upon retraction.

Figure 8:
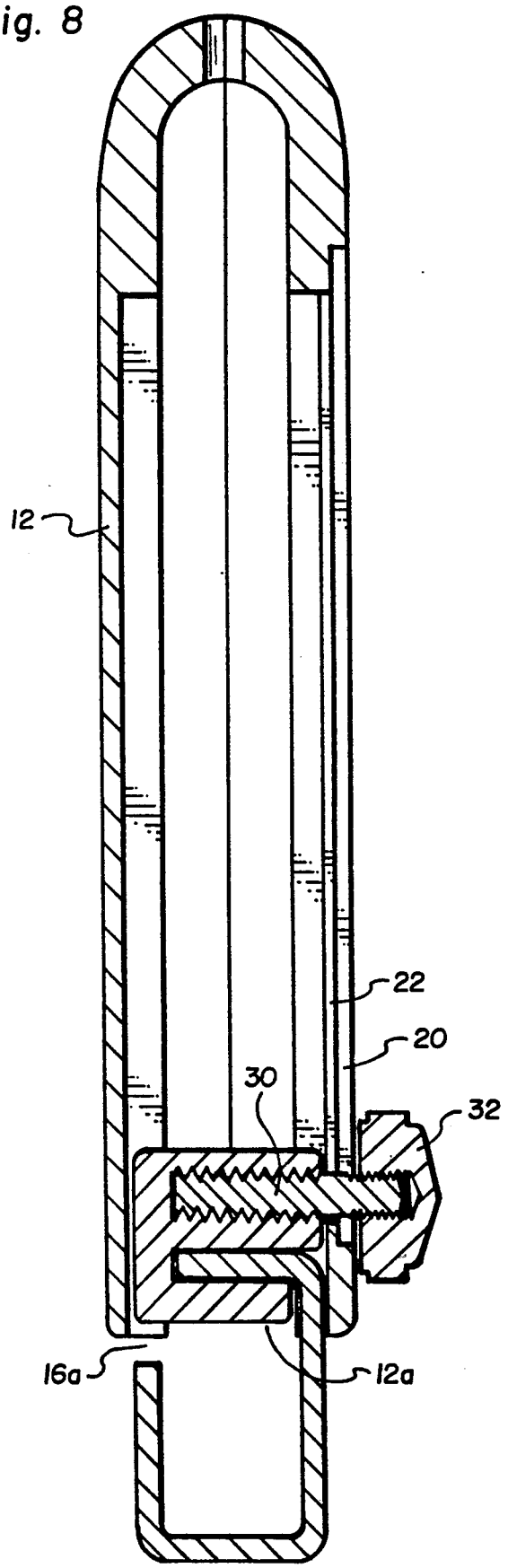
FIG. 8 is a detail side view in cross section of the key case of FIG. 1 in a position wherein keys may be added or removed.

Referring now to FIG. 8, to install keys on the bail 16 or remove keys from it, the thumbscrew 32 is partially (or totally) unscrewed from the connecting rod 30 and the user pushes the connecting rod 30 to its position nearest the open end 12*a* of the housing at the end of the slot 22. Since the thumbscrew 32 has been loosened (to the extent of two full turns in the preferred embodiment), it does not abut the side of the exterior groove 20 and therefore the connecting rod 30 is allowed to travel all the way to the end of the slot 22. This movement pushes the bail 16 out of the open end of the housing 12 far enough to expose the open corner 16*a* of the bail. Keys are then installed or removed as desired on the bail 16 by means of the open corner 16*a*. The connecting rod 30 is then pushed back from the end of the slot 22 and the thumbscrew 32 is again tightened onto the connecting rod 30 for conventional operation.

The preceding describes only one embodiment of the subject invention, modifications and variations of which remain within the scope of the invention. For example, other suitable sliding mechanisms between the mounting block 14 and housing 12 may be used, and the various attachments of one component to another may be carried out in any suitable fashion. Other changes to the described embodiment while remaining within the scope of the invention will be apparent to those skilled in the art.

I claim:

1. An apparatus for holding, ejecting, and retracting keys comprising:

an elongate housing having an opening at one end thereof and walls surrounding an interior cavity;

a first interior groove formed on an interior side of said walls;

holding means disposed in said housing in sliding engagement with said interior groove for holding keys;

moving means for moving said holding means longitudinally relative to said housing between a retracted position, in which the keys reside in the cavity, and an ejected position, in which the keys are moved through the opening to reside outside the housing;

wherein said holding means comprises a mounting block and a bail having sides disposed toward the walls of the housing, a bottom portion disposed toward the opening on which keys are placed, and a top portion disposed oppositely from the bottom portion, the bail being attached to said mounting block;

wherein a side of said bail is disposed in said interior groove, whereby said bail is placed in sliding engagement with said interior groove.

2. The key case of claim 1 further comprising a second interior groove disposed diametrically opposite the first interior groove on an interior side of said walls different from the interior side whereon said first interior groove is formed.

3. The apparatus of claim 1 wherein said moving means comprises a slot having a first end and a second end formed longitudinally in a wall of said housing, and a connecting rod disposed through said slot, said connecting rod being attached on one end to said holding means and having another end protruding exterior to said housing, whereby a user, by moving said protruding end, is able to move said holding means longitudinally relative to said housing.

4. The apparatus of claim 3 further comprising a thumbscrew selectively attached to the protruding end of said connecting rod, said thumbscrew being adjustable to increase or decrease the force needed to move said connecting rod along said slot, and further comprising an exterior groove having a plurality of sides formed exteriorly on said walls beneath said thumbscrew whereby movement of said thumbscrew toward the first end of said slot is delimited by the abutment of said thumbscrew against a side of said exterior groove, by which movement of said connecting rod is arrested due to its connection to said thumbscrew.

5. The apparatus of claim 4 wherein the first end of said slot is located farther toward the open end of said housing than the point at which movement of said connecting rod is arrested by the abutment of said thumbscrew against a side of said exterior groove, and wherein when said thumbscrew is loosened or removed said connecting rod is enabled to move to the first end of said slot.

6. A key case comprising:

an elongate housing having an open end thereof and walls surrounding an interior cavity;

a longitudinal slot having a first end and second end formed in a wall of said housing;

a key holding device having a key installation/removal point disposed thereon located in the interior cavity of said housing and adapted for longitudinal movement relative thereto;

a thumbscrew provided outside the walls of said housing and adapted for longitudinal movement along said housing;

a rod adapted for longitudinal movement by a user of the key case along said slot operatively connecting said key holding device to said thumbscrew through said slot, said thumbscrew being adapted to move along the longitudinal axis of the rod toward and away from the key holding device, selectively;

means for preventing the rod from being moved to the first end of the slot when the thumbscrew is positioned a predetermined distance toward the key holding device along the rod;

said thumbscrew being selectively removable from said rod, whereby when said thumbscrew is removed from said rod or when the thumbscrew moves a predetermined distance along the rod away from the key holding device and said rod is thereby enabled to move longitudinally to the first end of the said slot, said key holding device moves longitudinally by reason of its connection to said rod and protrudes from the open end of said housing, exposing the key installation/removal point.

7. The key case of claim 6 further comprising means for guiding the movement of said key holding device in said housing.

8. The key case of claim 7 wherein said means for guiding movement comprises an interior longitudinal recess disposed interiorly on a wall of said housing and which is slidingly attached to said key holding device.

9. The key case of claim 8 wherein said key holding device includes a protrusion extending into said interior recess for sliding movement.

10. The key case of claim 6 wherein said key holding device comprises a mounting block attached to a bail upon which keys are mounted, and further comprising means for slidingly attaching said mounting block to the side of said cavity.

11. A key case comprising:

an elongate housing having an open end and a closed end and walls defining an interior cavity;

a first groove disposed exteriorly on a wall of said housing, said groove having a first end and a second end, the first end being nearer to the open end of said housing than the second end;

a slot smaller in length than and substantially centered in said groove, said slot having a first end and a second end corresponding to the first and second ends of said first groove;

a second groove disposed in said interior cavity on a wall of said housing;

a mounting block disposed in said cavity adapted for movement along said second groove;

an arm protruding from said mounting block into said second groove adapted to guide movement of said mounting block along said second groove;

a connector having a first end and a second end disposed through said slot, the first end being secured to said mounting block;

means releasably secured to the second end of said connector for manually displacing said connector, said manual displacement means being slidingly engaged with said first groove when secured to the second end of said connector;

a bail adapted to hold keys secured to said mounting block such that a side of said bail engages said second groove in sliding relationship, said bail including an open point at which keys may be added or removed to said bail, whereby when said manual displacement means is placed at said first end of said first groove, part of said bail not including said open point protrudes from the open end of said housing, and when said manual displacement means is removed from said connector and said connector is placed at the first end of said slot, a greater portion of said bail, including said open point, protrudes from the open end of said housing.

12. The key case of claim 11 wherein said manual displacement means comprises a thumbscrew which may be tightened or loosened against the side of said housing, making it respectively harder or easier to move said connecting rod along said slot.

13. The key case of claim 11 wherein said bail is substantially rectangular with the open point comprising an open corner of the rectangle, the section of the rectangle nearest the open end of said housing being adapted to snugly hold a plurality of keys against each other and the side sections of the rectangle such that movement of the keys other than pivotal movement around the axis of the bottom section of the rectangle is prevented.

14. The key case of claim 11 further comprising a third groove disposed in said cavity on a wall of said housing, and a second arm protruding from said mounting block in sliding relationship with said third groove.

15. The key case of claim 11 wherein the interior cavity in said housing is smaller in cross-section near the closed end of said housing than near the open end thereof, whereby when said mounting block is moved toward the closed end in a retracted position it is secured therein by pressure exerted against it by the walls of said housing.

* * * * *